US005181766A

United States Patent [19]

Heintzmannn et al.

[11] Patent Number: 5,181,766

[45] Date of Patent: Jan. 26, 1993

[54] SYSTEM FOR CUTTING AND CONVEYING COAL AND THE LIKE

[75] Inventors: Peter Heintzmannn, Bochum; Kuno Guse, Witten-Bommern, both of Fed. Rep. of Germany

[73] Assignee: Bochumer Eisenhutte Heintzmann GmbH & Co. KG, Bochum, Fed. Rep. of Germany

[21] Appl. No.: 854,825

[22] Filed: Mar. 19, 1992

[30] Foreign Application Priority Data

Mar. 21, 1991 [DE] Fed. Rep. of Germany ..... 4109290

[51] Int. Cl.[5] ..... E21B 25/56

[52] U.S. Cl. ..... 299/34

[58] Field of Search ..... 299/32, 34, 43

[56] References Cited

FOREIGN PATENT DOCUMENTS 3545302 7/1987 Fed. Rep. of Germany ..... 299/34

3318360 11/1989 Fed. Rep. of Germany .

*Primary Examiner*—David J. Bagnell

*Attorney, Agent, or Firm*—Herbert Dubno; Andrew Wilford

[57] ABSTRACT

A long-wall mining apparatus has a conveyor trough extending longitudinally from a turnaround adjacent a longitudinal face from which material is to be cut, a pair of longitudinally extending and generally parallel rear guide rails extending along and flanking the conveyor, a pair of longitudinally extending and generally parallel front guide rails extending along the face between the conveyor trough and the face, and a longitudinally fixed anchor bollard in the turnaround provided with upper and lower guide rails each connecting a respective one of the front guide rails to a respective one of the rear guide rails. A drive wheel in the bollard rotates about an upright axis and has an outer periphery exposed between the bollard guide rails. A chain having front and rear stretches respectively running along the guide rails is engaged in the turnaround with the periphery of the drive wheel. Conveyor/cutting elements on the chain ride on the rails to move in the front stretch along the face and in the rear stretch along the trough. A drive motor at the turnaround connected to the drive wheel advances the chain in the front stretch to scrape material from the face and deposit it in the conveyor trough and displaces the chain toward the turnaround in the rear stretch to move the scraped-off material along the trough.

6 Claims, 4 Drawing Sheets

SYSTEM FOR CUTTING AND CONVEYING COAL AND THE LIKE

FIELD OF THE INVENTION

The present invention relates to a system for cutting a granular mineral material like coal and for conveying it from the cutting location. More particularly this invention concerns a long-wall mining apparatus.

BACKGROUND OF THE INVENTION

A typical longwall mining apparatus such as described in German patent documents 3,318,360 of P. Heintzmann, 3,514,439 of G. Blumenthal, 3,743,239 of G. Blumenthal (U.S. equivalent Pat. No. 4,883,322), and 4,004,488 of K. Plaga (U.S. equivalent Pat. No. 5,688,796) has a main conveyor chain that extends as parallel front and rear stretches along a face being worked between a pair of turnarounds. One of the turnarounds is in a takeoff shaft or heading leading back from the face and containing a takeoff conveyor and the other is in an access shaft or heading that normally extends parallel to the takeoff shaft. The rear stretch of the chain runs in a conveyor trough parallel to the face and the front stretch runs along the face being worked. Conveyor/cutting elements mounted on the chain are set in the front stretch in a vertical position in which they engage the face and plow material off it so that this material drops into the conveyor trough. In the rear stretch the conveyor/cutting elements are moved to a horizontal position in the trough where they push the recovered material along to the end of the trough where a takeoff conveyor extending away from the face in the takeoff shaft carries away the recovered material.

At each turnaround there is a wheel or sprocket over which the chain is engaged. As a rule a main drive is provided in the main takeoff shaft where there is substantial room, and an auxiliary drive is provided at the other turnaround in the small access shaft at the other end of the face being worked. A separate device at the takeoff-shaft turnaround transfers the material from the conveyor trough to the takeoff conveyor.

In the standard prior-art system such as described in above-mentioned German patent document 3,318,360 the turnarounds each have a ramp so that as the elements move in the access-shaft turnaround from the front stretch to the back stretch they move from the erect to the recumbent position and at the takeoff-shaft turnaround they move from the erect to the recumbent position. These systems are, however, fairly bulky and expensive, in particular as regards the required angled wheels at the turn-arounds.

OBJECTS OF THE INVENTION

It is therefore an object of the present invention to provide an improved long-wall mining apparatus.

Another object is the provision of such an improved long-wall mining apparatus which overcomes the above-given disadvantages, that is which is fairly compact in particular at the turnarounds.

SUMMARY OF THE INVENTION

A long-wall mining apparatus according to this invention has a conveyor trough extending longitudinally from a turnaround adjacent a longitudinal face from which material is to be cut, a pair of longitudinally extending and generally parallel rear guide rails extending along and flanking the conveyor, a pair of longitudinally extending and generally parallel front guide rails extending along the face between the conveyor trough and the face, and a longitudinally fixed anchor bollard in the turnaround provided with upper and lower guide rails each connecting a respective one of the front guide rials to a respective one of the rear guide rails. A drive wheel in the bollard rotates about an upright axis and has an outer periphery exposed between the bollard guide rails. A chain having front and rear stretches respectively running along the guide rails is engaged in the turnaround with the periphery of the drive wheel. Conveyor/cutting elements on the chain ride on the rails to move in the front stretch along the face and in the rear stretch along the trough. A drive motor at the turnaround connected to the drive wheel advances the chain in the front stretch to scrape material from the face and deposit it in the conveyor trough and displaces the chain toward the turnaround in the rear stretch to move the scraped-off material along the trough.

Thus it is possible to do away with the standard ramps at the turnaround location. Making the drive wheel rotatable about a vertical axis greatly vertically shortens the entire assembly with no loss of efficiency. The height of the turn-around bollard can practically be reduced to the width of the width of the conveyor/cutting elements. The bollard can be wholly stationary, or its outer surface can rotate with the drive wheel.

According to the invention the bollard has a generally frustoconical outer surface carrying the bollard rials and from which the circular and toothed wheel periphery projects. Each guide rail has an end section connecting itself to the respective bollard rail and extending at an angle to the respective guide rail. Furthermore a transmission underneath the bollard is connected between the drive motor and the wheel.

In accordance with a further feature of the invention a takeoff conveyor underneath the conveyor trough at the turnaround receives recovered material from the conveyor trough and the transmission has a height generally equal to a height of the takeoff conveyor in the turnaround. The bollard can be provided with a side wall forming a longitudinal extension of the conveyor trough.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
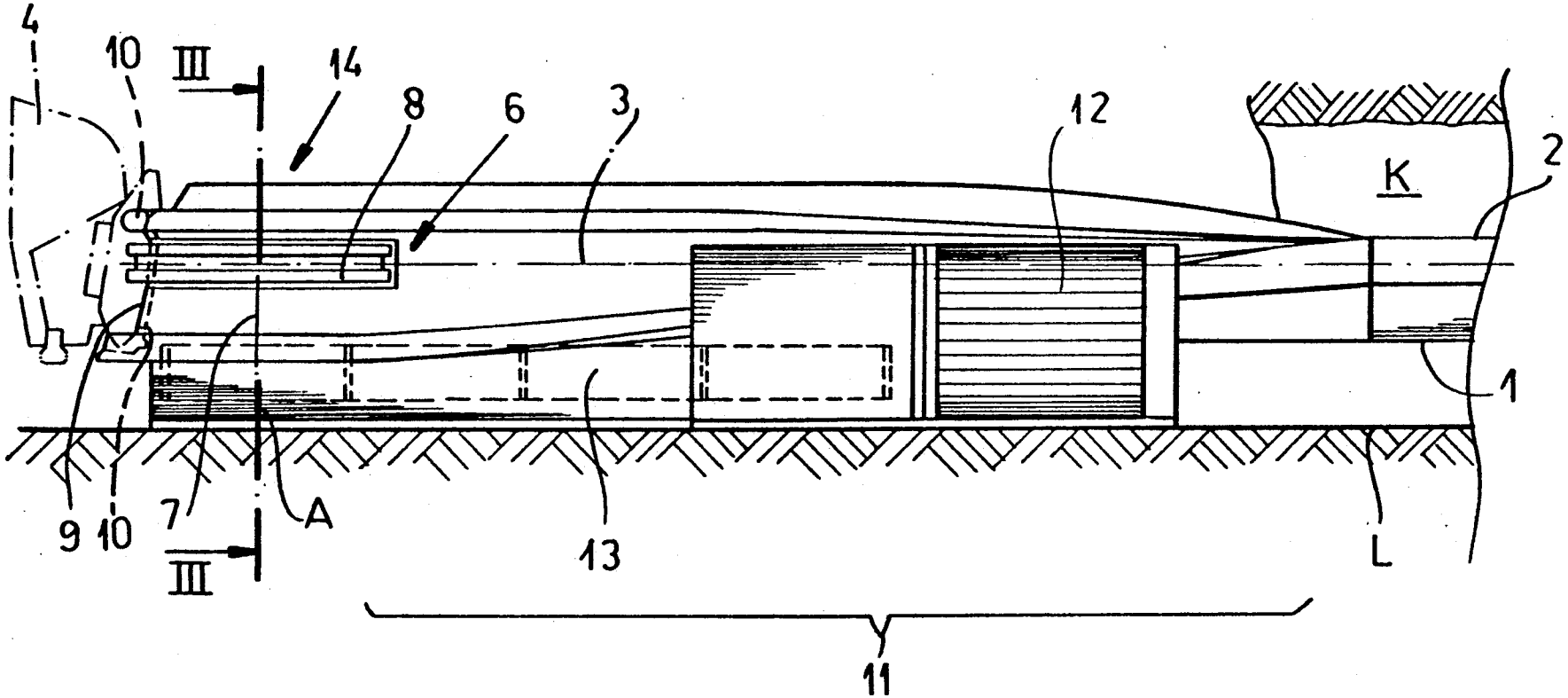
FIG. 1 is a partly diagrammatic side view of the apparatus according to the invention.
Figure 2:
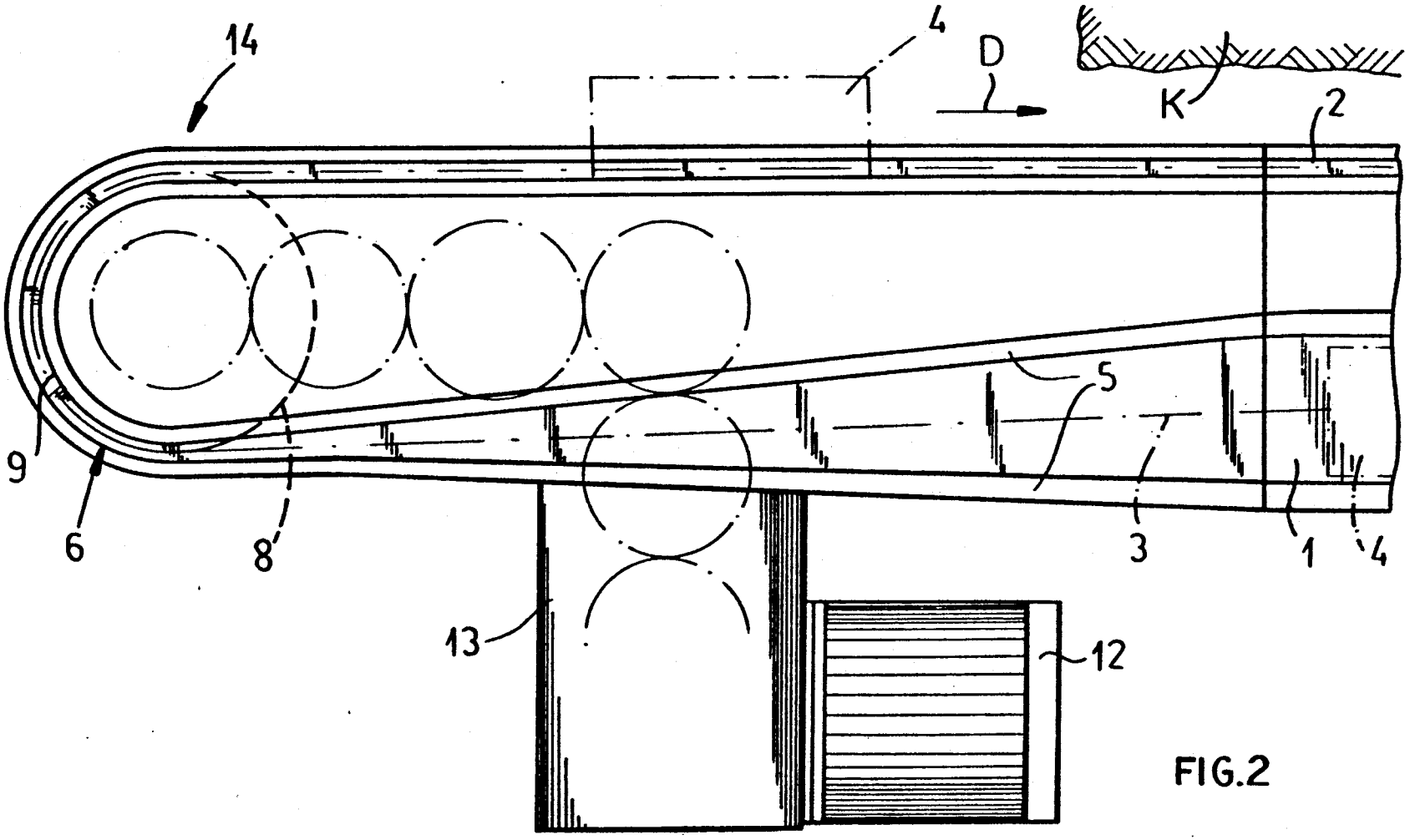
FIG. 2 is a top view of the apparatus of FIG. 1.

As seen in FIGS. 1 and 2 a conveyor trough 1 lies between two parallel rear guide rails 5 extending parallel to but spaced from a coal face K being worked, with the conveyor trough 1 supported a short distance above the mine floor L. A pair of front guide rails 2 extend along the face K between the conveyor 1 and this face K. A chain 3 has a front stretch extending along the face K between the rails 2 and a rear stretch running along the trough 1, and is reversed in a turnaround 6 normally located in the takeoff tunnel that is provided with a takeoff conveyor. Elements 4 fixed to the chain 3 are moved in the direction D away from the turnaround 6 in an erect posture to scrape coal from the face F and deposit it in the trough 1. This coal is pushed along the trough 1 in the opposite direction by the same elements 4 which are moved in a recumbent posture along this trough 1. To this end the front rails 2 are positioned vertically well above each other to erect the elements 4 and the rails 5 are generally level with each other but horizontally spaced.

Figure 3:
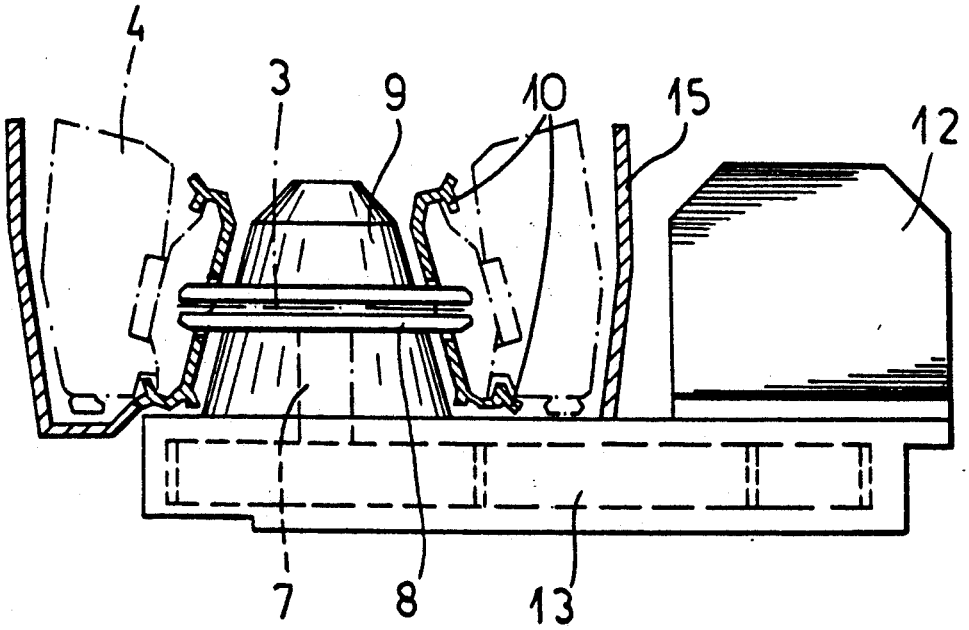
FIG. 3 is a vertical section taken along line III—III of FIG. 1.

In the turnaround location 6 a longitudinally fixed bollard 9 is provided centered on an upright axis A. This bollard 9 is formed as shown in FIG. 3 with a frustoconical outer surface and is provided with a pair of rails 10 that form continuations of the rails 2 and 5, each rail 10 connecting a respective one of the rails 2 to a respective one of the rails 5. A shaft 7 extending along the axis A carries a wheel 8 whose periphery projects from the surface of the bollard 9 and is provided with teeth that engage in the chain 3 so it can drive same. A motor 12 lying on the floor L is connected through a vertically short transmission 13 to the wheel 8 to rotate it and drive the chain 3 in the direction D. The transmission 13 is so short that it is accommodated under a location 14 where the conveyor trough 1 empties into the unillustrated takeoff conveyor. In addition as shown in FIG. 3 a wall 15 can be provided forming an extension of the back wall of the conveyor trough 1 to prevent coal from being lost from same.

The bollard rails 10 can be mounted on the drive wheel 8 as shown in FIG. 3 so that they rotate with it. In this case transition rail sections 11 are provided to mate the rials 1 and 5 that are at different levels with these rials 10.

Figure 4:
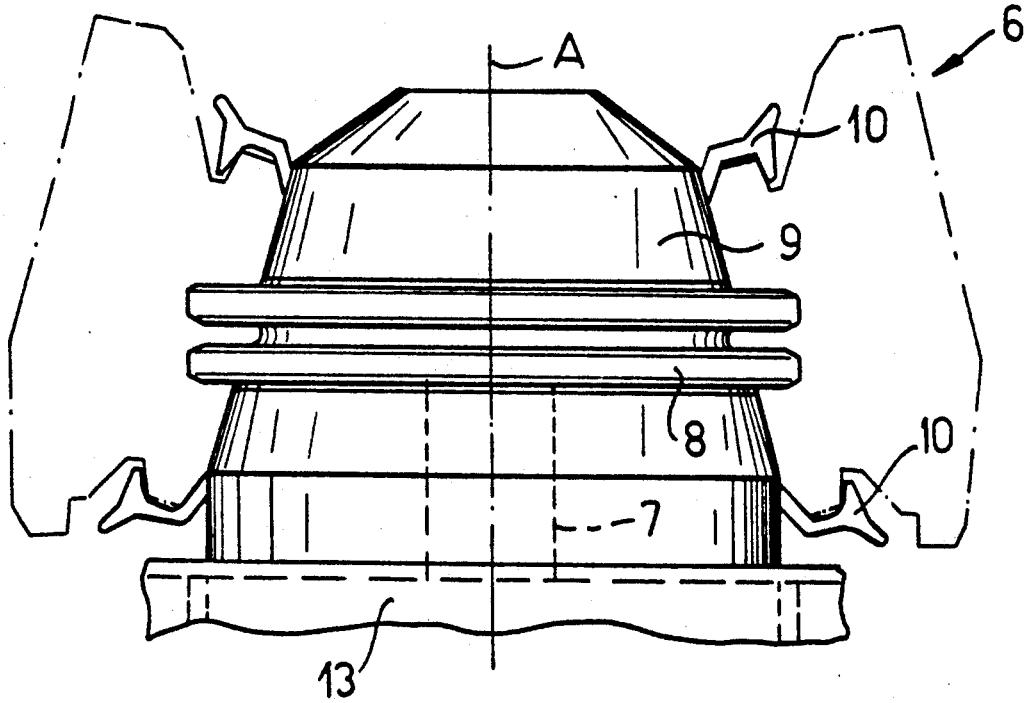
FIGS. 4 and 5 are views like FIG. 3 illustrating alternative arrangements according to the invention.
Figure 5:
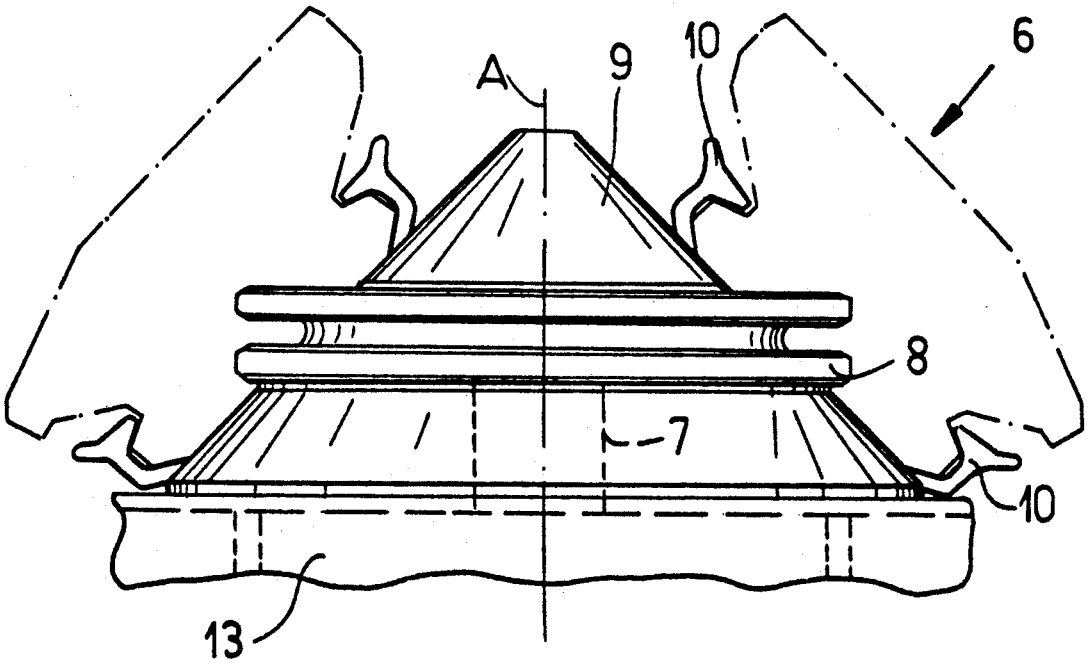

Alternately as shown in FIG. 5 the rials 10 can be mounted on the stationary bollard surface so that they themselves can form the transition regions 11 that compensate for the differences in height between some of the rails 2 and 5 and the rails 11 they must join so that the elements 4 can slide smoothly around the turnaround 6. In addition FIG. 5 shows that the bollard 9 has an apex angle of about 90°, giving it a nearly conical shape as compared to the nearly cylindrical shape of the bollard 9 of FIG. 4.

We claim:

1. A long-wall mining apparatus comprising:

a conveyor trough extending longitudinally from a turnaround adjacent a longitudinal face from which material is to be cut;

a pair of longitudinally extending and generally parallel rear guide rails extending along and flanking the conveyor;

a pair of longitudinally extending and generally parallel front guide rails extending along the face between the conveyor trough and the face;

a longitudinally fixed anchor bollard in the turnaround provided with upper and lower guide rails each connecting a respective one of the front guide rails to a respective one of the rear guide rails;

a drive wheel in the bollard rotatable about an upright axis and having an outer periphery exposed between the bollard guide rails;

a chain having front and rear stretches respectively running along the guide rails and engaged in the turnaround with the periphery of the drive wheel;

conveyor/cutting elements on the chain riding on the rails and displaceable in the front stretch along the face and in the rear stretch along the trough; and a drive motor at the turnaround connected to the drive wheel for advancing the chain in the front stretch to scrape material from the face and deposit it in the conveyor trough and for displacing the chain toward the turnaround in the rear stretch to move the scraped-off material along the trough.

2. The long-wall mining apparatus defined in claim 1 wherein the bollard has a generally frustoconical outer surface carrying the bollard rails and from which the wheel periphery projects.

3. The long-wall mining apparatus defined in claim 1 wherein each guide rail has an end section connecting itself to the respective bollard rail and extending at an angle to the respective guide rail.

4. The long-wall mining apparatus defined in claim 1, further comprising a transmission underneath the bollard connected between the drive motor and the wheel.

5. The long-wall mining apparatus defined in claim 4, further comprising a takeoff conveyor underneath the conveyor trough at the turnaround and receiving recovered material from the conveyor trough, the transmission having a height generally equal to a height of the takeoff conveyor in the turnaround.

6. The long-wall mining apparatus defined in claim 1, further comprising a takeoff conveyor underneath the conveyor trough at the turnaround, the bollard being provided with a side wall forming a longitudinal extension of the conveyor trough.

* * * * *